US009506215B2

(12) United States Patent
Krell et al.

(10) Patent No.: US 9,506,215 B2
(45) Date of Patent: Nov. 29, 2016

(54) COMBINATION EXCAVATING BUCKET HAVING A RETRACTABLE TOOTH ARM

(71) Applicants: Trent Krell, Redcliff (CA); Chad Goldade, Redcliff (CA)

(72) Inventors: Trent Krell, Redcliff (CA); Chad Goldade, Redcliff (CA)

( * ) Notice: Subject to any disclaimer, the term of this patent is extended or adjusted under 35 U.S.C. 154(b) by 0 days.

(21) Appl. No.: 15/056,597

(22) Filed: Feb. 29, 2016

(65) Prior Publication Data

US 2016/0177537 A1 Jun. 23, 2016

Related U.S. Application Data

(63) Continuation-in-part of application No. 14/138,668, filed on Dec. 23, 2013, now abandoned.

(51) Int. Cl.
*E02F 3/96* (2006.01)
*E02F 3/40* (2006.01)
*E02F 9/28* (2006.01)

(52) U.S. Cl.
CPC ..... *E02F 3/40* (2013.01); *E02F 3/404* (2013.01); *E02F 3/96* (2013.01); *E02F 9/2816* (2013.01)

(58) Field of Classification Search
CPC ..... E02F 3/28; E02F 3/76; E02F 3/8152; E02F 3/96
USPC ..... 37/405, 407, 408, 409, 444, 449, 903; 172/777; 414/722
See application file for complete search history.

(56) References Cited

U.S. PATENT DOCUMENTS

| | | | | | |
|---|---|---|---|---|---|
| 2,262,415 | A * | 11/1941 | Williams | E02F 3/8155 | 172/777 |
| 3,595,416 | A * | 7/1971 | Perrotti | E02F 3/401 | 37/405 |
| 3,975,844 | A * | 8/1976 | Olson | E02F 3/404 | 37/405 |
| 4,729,180 | A * | 3/1988 | Hendricks | E02F 9/2808 | 37/450 |
| 4,928,410 | A * | 5/1990 | Walters | E02F 3/404 | 172/254 |
| 6,230,424 | B1 * | 5/2001 | Renski | E02F 3/8152 | 172/772.5 |
| 7,913,431 | B1 * | 3/2011 | Beam | A01G 23/06 | 37/406 |
| 2004/0103564 | A1 * | 6/2004 | Ferguson | E02F 3/8152 | 37/444 |
| 2015/0176241 | A1 * | 6/2015 | Krell | E02F 9/2816 | 37/444 |

* cited by examiner

*Primary Examiner* — Gary Hartmann
(74) *Attorney, Agent, or Firm* — McQIPLaw; Jeffrey McQuiston

(57) ABSTRACT

A combination excavating bucket adapted for connection to a power driven excavating vehicle, comprising: a) bucket comprising a transverse smooth cutting bar along its front bottom edge, b) a retractable tooth bar pivotally mounted to inner opposed lateral sides of the excavating bucket, wherein the tooth bar comprises a plurality of teeth extending outwardly from the tooth bar, and a pivot means for alternately moving the tooth bar between i) a fully-extended position, wherein the tooth bar fits over the smooth cutting bar thereby permitting the bucket to function as a tooth-edged bucket; and ii) a fully-retracted position, wherein the tooth bar is retracted away from the smooth cutting bar and the smooth cutting bar is exposed thereby permitting the bucket to function as a smooth-edged bucket, wherein the pivot means comprises first and second pivot arms pivotally mounted to the bucket.

10 Claims, 5 Drawing Sheets

COMBINATION EXCAVATING BUCKET HAVING A RETRACTABLE TOOTH ARM

CROSS REFERENCE TO RELATED APPLICATION

This application is a continuation-in-part of applicant's co-pending application Ser. No. 14/138,668, filed Dec. 23, 2013, the entire contents of which is hereby expressly incorporated by reference herein.

FIELD OF THE INVENTION

The present disclosure is in the field of a combination excavating bucket having a retractable tooth bar, thereby enabling the excavating bucket to function as both a smooth-edged excavation bucket and a tooth-edged excavating bucket.

BACKGROUND OF THE DISCLOSURE

European Patent Publication No. EP1967655 discloses an excavator bucket having a crushing mechanism comprised of a stationary part and a movable part which is drivingly connected with one or more hydraulic cylinders. The described excavator bucket further includes a gripping mechanism, and is therefore said to be a three-in-one excavator bucket and crusher that optionally may be used for excavation, crushing or sorting work.

U.S. Pat. No. 5,564,885 discloses a multipurpose work attachment for a front-end loader of the type having hydraulically actuated frame arms for supporting and manipulating a work attachment at the front of the vehicle. The work attachments includes a scoop or bucket in combination with a laterally extending row of ripper teeth mounted along a lower edge of the bucket and adapted from hydraulic actuation between an upper stored position and a downwardly extending deployed position for ripping earth upon vehicle movement in a reverse direction.

U.S. Pat. No. 6,810,610 discloses an edging device consisting of two major components: an edge member or plate and means for attaching the edge member to the bucket of an earth moving machine. The edge member is configured to be detachably attached to the bucket, where the edge member has a leading edge for contacting the earth. The edge member is described as being easily and quickly bolted to the bucket for use in smoothing the ground surface, but also removable without damaging the bucket. The described "bolt-on edge system" is a ground engaging tool that is said to replace the practice of welding an edge to the bucket teeth of on earth moving equipment such as backhoes, loaders and excavators.

However, the aforementioned excavating buckets do not provide a combination bucket that allows the operator of an excavating vehicle to easily alternate between using the bucket as a smooth-edged excavating bucket and a tooth-edged excavating bucket.

Thus, there exists a need for a combination excavating bucket which allows the operator of an excavating vehicle to easily and quickly alternate between using the bucket as a smooth-edged excavating bucket and a tooth-edged excavating bucket. The present invention substantially fulfills this need.

SUMMARY OF THE INVENTION

A combination excavating bucket adapted for connection to a power driven excavating vehicle, comprising: a) bucket comprising a transverse smooth cutting bar along its front bottom edge, b) a retractable tooth bar pivotally mounted to inner opposed lateral sides of the excavating bucket, wherein the tooth bar comprises a plurality of teeth extending outwardly from the tooth bar, and a pivot means for alternately moving the tooth bar between i) a fully-extended position, wherein the tooth bar fits over the smooth cutting bar thereby permitting the bucket to function as a tooth-edged bucket; and ii) a fully-retracted position, wherein the tooth bar is retracted away from the smooth cutting bar and the smooth cutting bar is exposed thereby permitting the bucket to function as a smooth-edged bucket, wherein the pivot means comprises first and second pivot arms pivotally mounted to the bucket, a first link arm operably connecting the first pivot arm to the tooth bar and a second link arm operably connecting the second pivot arm to the tooth bar along the inner opposed lateral sides of the excavating bucket.

DETAILED DESCRIPTION OF THE EMBODIMENTS

The following is a detailed description of certain specific embodiments of the combination excavating buckets disclosed herein. In this description reference is made to the drawings.

In one aspect, disclosed herein is a combination excavating bucket adapted for connection to a power driven excavating vehicle, comprising: a) bucket comprising a transverse smooth cutting bar along its front bottom edge, b) a retractable tooth bar pivotally mounted to inner opposed lateral sides of the excavating bucket, wherein the tooth bar comprises a plurality of teeth extending outwardly from the tooth bar, and a pivot means for alternately moving the tooth bar between i) a fully-extended position, wherein the tooth bar fits over the smooth cutting bar thereby permitting the bucket to function as a tooth-edged bucket; and ii) a fully-retracted position, wherein the tooth bar is retracted away from the smooth cutting bar and the smooth cutting bar is exposed thereby permitting the bucket to function as a smooth-edged bucket, wherein the pivot means comprises first and second pivot arms pivotally mounted to the bucket, a first link arm operably connecting the first pivot arm to the tooth bar and a second link arm operably connecting the second pivot arm to the tooth bar along the inner opposed lateral sides of the excavating bucket, and wherein the first link arm and second link arm are operably guided with a first and a second guide ring plate along the inner opposed lateral sides of the excavating bucket.

Figure 1:
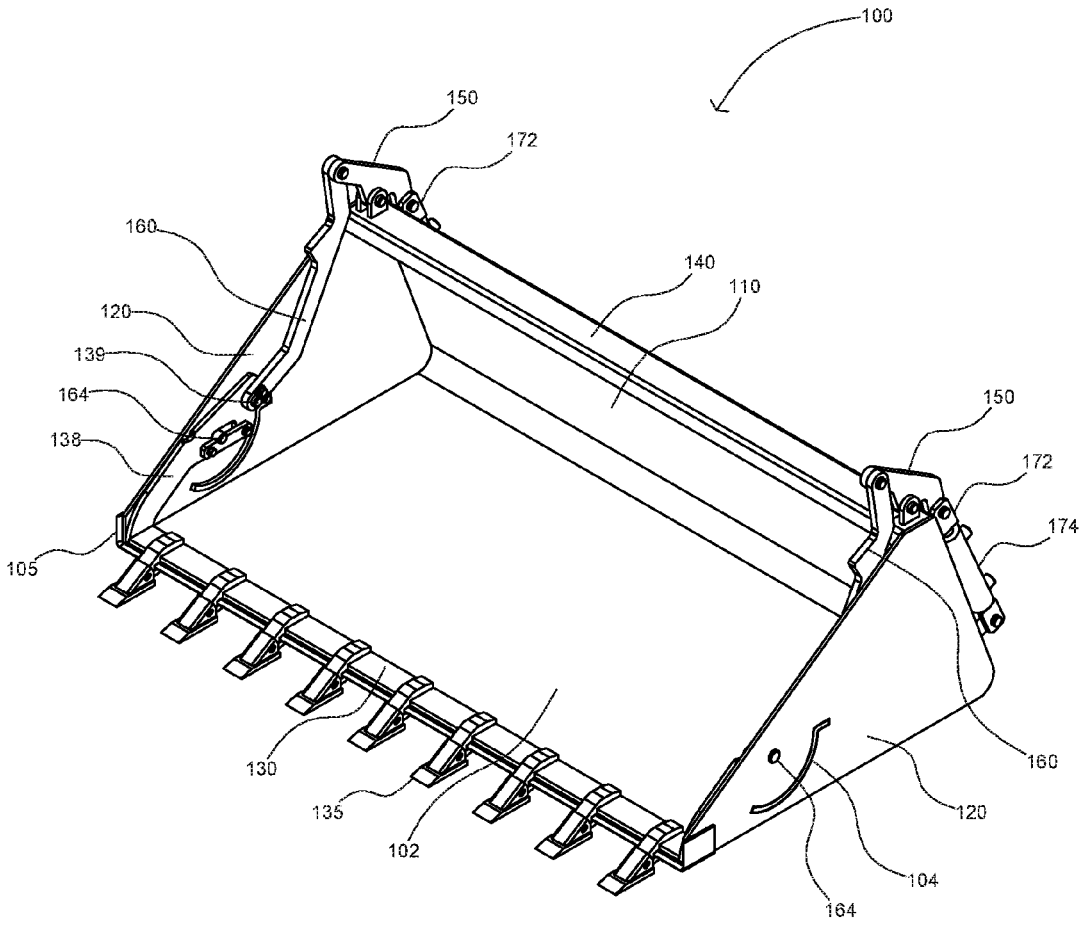
FIG. 1 is a perspective view of an embodiment of the present invention, with the retractable tooth bar in a down position.

Turning to the drawings, FIG. 1 shows combination excavating bucket 100 having a base 102, rear wall 110 and lateral sides 120. Smooth cutting bar 105 runs along the leading edge of base 102. Thus, smooth cutting bar 105 is not visible. Tooth bar 130, shown here in a fully-extended position, includes a plurality of teeth 135, and is pivotally connected to the inner portion of lateral sides 120 by tooth bar side-arms 138. Link arms 160 connect tooth bar 130 to pivot arms 150, which in turn are connected to hydraulic actuators 170 via hydraulic cylinder rods 172. Hydraulic cylinder rods 172 are fully retracted within hydraulic cylinders 174 and therefore not visible. Pivot arms 150 are attached to opposite ends of rear wall top edge 140. Hydraulic actuators 170 are connected to the posterior surface of rear wall 110 at opposite ends. In some embodiments, the pivot means further comprises a first hydraulic actuator operably connected to the first pivot arm and a second hydraulic actuator operably connected to the second pivot arm. In some embodiments, the first hydraulic actuator comprises a first hydraulic cylinder and a first hydraulic cylinder rod, and the second hydraulic actuator comprises a second hydraulic cylinder and a second hydraulic cylinder rod. In some embodiments, the first hydraulic cylinder rod is pivotally connected to the first pivot arm and the second hydraulic cylinder rod is pivotally connected to the second pivot arm. In operation, excavating bucket 200 is connected to an excavating vehicle, thereby allowing the driver of the vehicle to control the position of tooth bar 130 by alternately moving hydraulic cylinder rods 172 between a fully-retracted position (See FIG. 3) and an partially-extended position (See FIG. 2).

Figure 2:
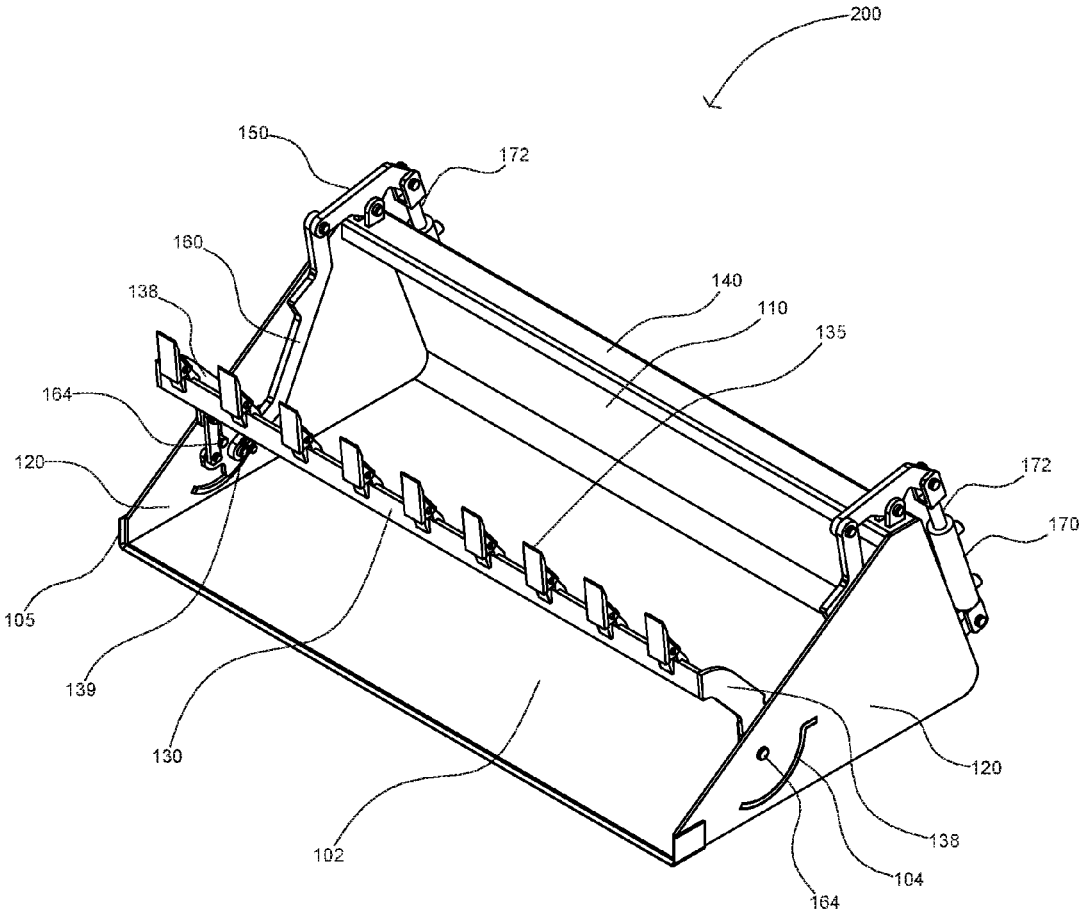
FIG. 2 is a perspective view of an embodiment of the present invention, with the retractable tooth bar in a partially-extended position.

FIG. 2 shows combination excavating bucket 200 having a base 102, rear wall 110 and lateral sides 120. Smooth cutting bar 105 runs along the leading edge of base 102. Tooth bar 130, shown here in a partially-extended position, includes a plurality of teeth 135, and is pivotally connected to the inner portion of lateral sides 120 by tooth bar side-arms 138. Link arms 160 connect tooth bar 130 to pivot arms 150, which in turn are connected to hydraulic actuators 170 via hydraulic cylinder rods 172. Pivot arms 150 are attached to opposite ends of rear wall top edge 140. Hydraulic actuators 170 are connected to the posterior surface of rear wall 110 at opposite ends.

Figure 3:
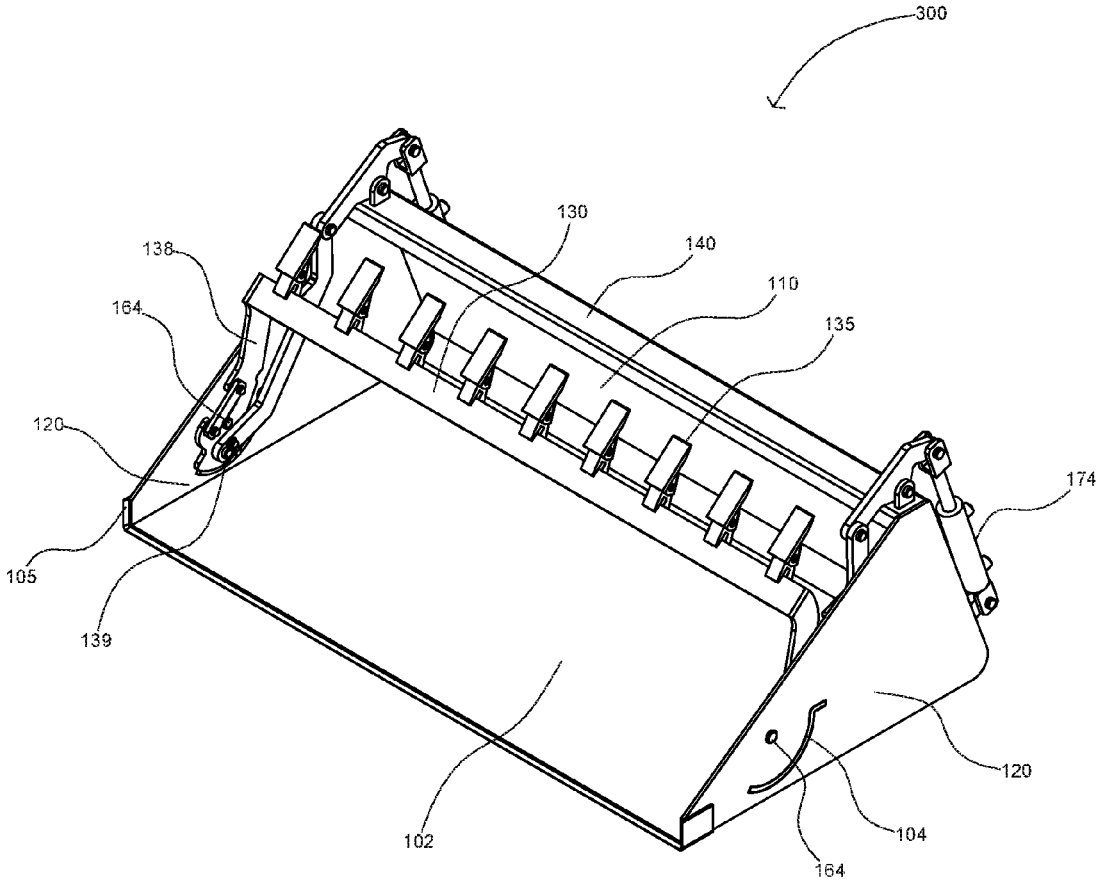
FIG. 3 is a perspective view of an embodiment of the present invention, with the retractable tooth bar in an up position.

FIG. 3 shows combination excavating bucket 300 with tooth bar 130 in a fully-retracted position. Hydraulic cylinder rods 172 are fully-extended and are therefore visible. Smooth cutting bar 105 is fully exposed, thereby allowing excavating bucket 300 to function as a smooth-edged excavating bucket. In the fully-retracted position tooth bar 130 may rest against rear wall top edge 140. In some embodiments, the combination excavating bucket adapted for connection to a power driven excavating vehicle further comprises that an angle of rotation from the fully-extended position to the fully-retracted position is about 163 degrees.

Moving hydraulic cylinder rods 172 to a retracted position causes tooth bar 130 to be positioned over smooth cutting bar 105, thereby allowing excavating bucket 100 to function as a tooth-edged excavating bucket. Moving hydraulic cylinder rods 172 to a fully-extended position causes tooth bar 130 to move to a fully-retracted position, exposing smooth cutting bar 105, and thereby allowing excavating bucket 300 to function as a smooth-edged excavating bucket.

Figure 4:
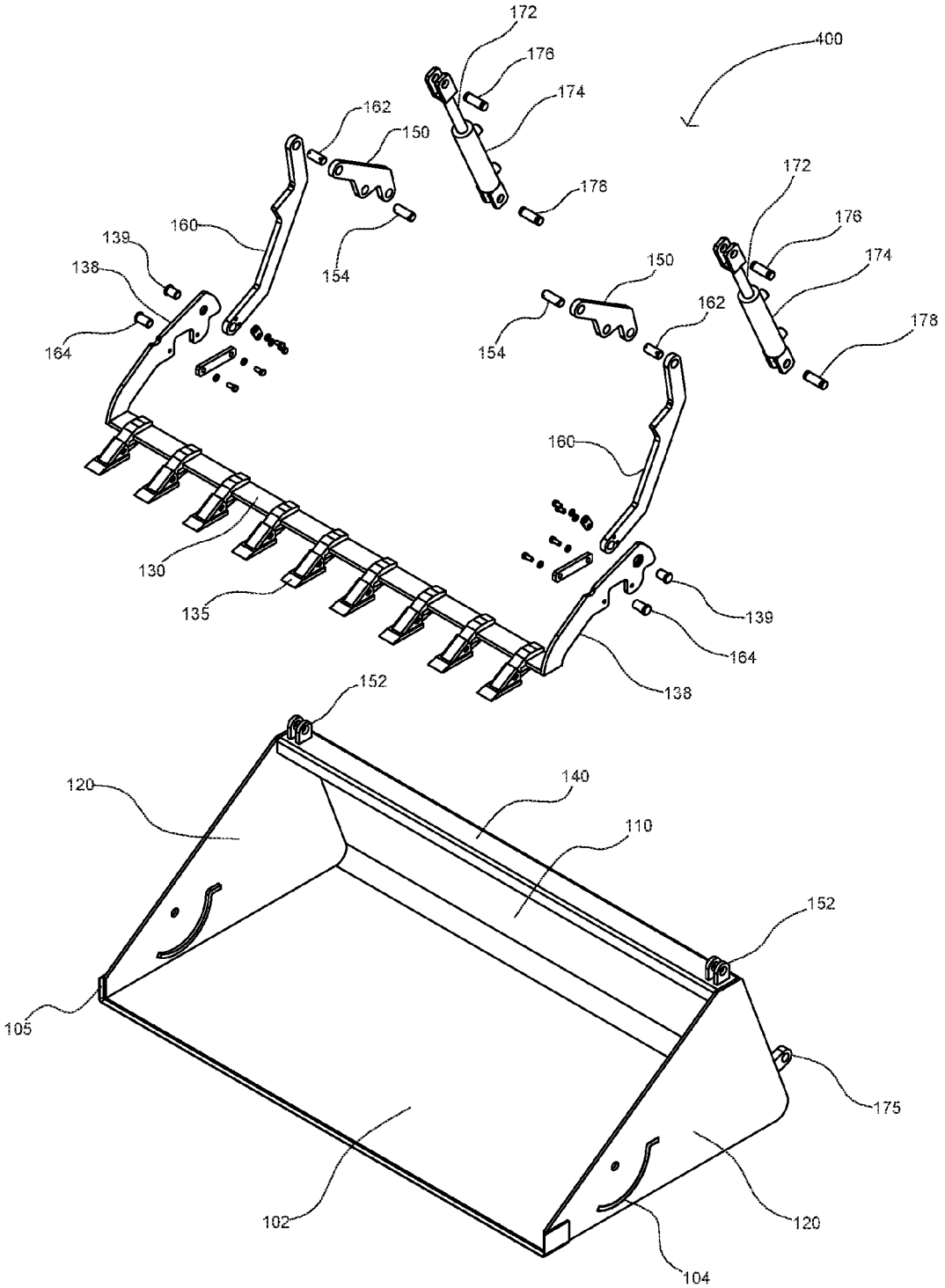
FIG. 4 is an exploded view of the parts of an embodiment of the present invention.

FIG. 4 illustrates an exploded view of the components of the combination excavating bucket 400 having base 102, rear wall 110, later sides 120, rear wall top edge 140 pivot arm hinge lugs 152 and one of the two hydraulic actuator lugs 175. Also shown is tooth bar 130 having tooth bar arms 138 and tooth bar hinge pins 164. Link arms 160 are secured to tooth bar arms 138 and pivot arms 150 by link arm hinge pins 139 and link arm hinge pins 162, respectively. Pivot arms hinge pins 154 secure pivot arms 150 to pivot arm hinge lugs 152, which in turn are secured at opposite ends of rear wall top edge 140. Hydraulic actuator hinge pins 176 secure hydraulic actuators 170 to pivot arms 150. Hydraulic actuators 170 are secured to the posterior surface of rear wall 110 at opposite ends via two hydraulic actuator lugs 175 using hydraulic actuator hinge pins 178.

Figure 5A:
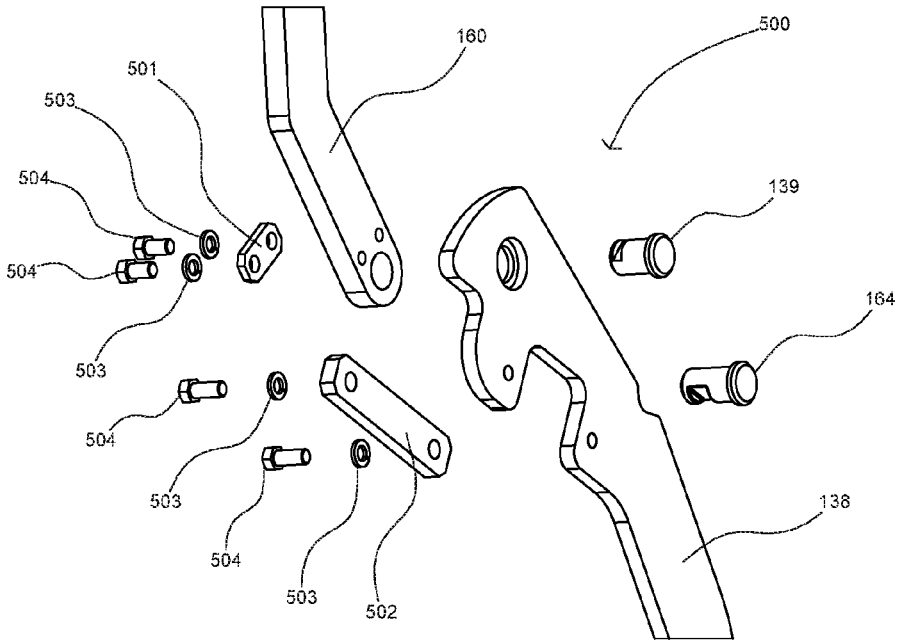
FIG. 5A is an exploded view of a tooth bar side-arms 138 and a link arm 160 of an embodiment of the present invention.
Figure 5B:
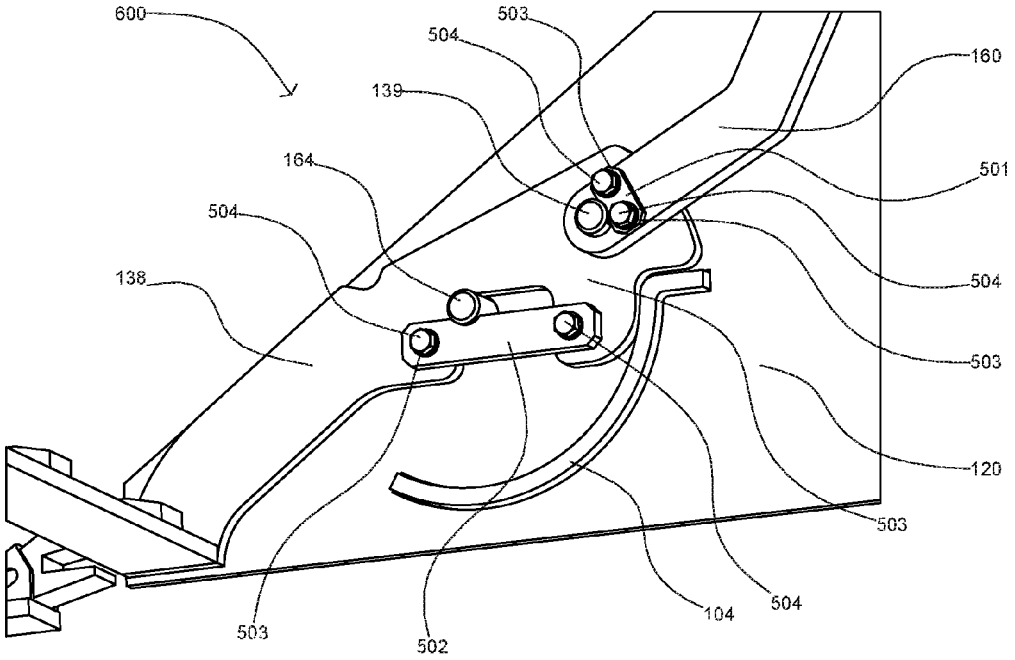
FIG. 5B is a view of a tooth bar side-arm 138 and a link arm 160 of an embodiment of the present invention.

FIGS. 5A and 5B show an exploded and side view of embodiments of the combination excavating bucket 500 and 600, respectively. The combination excavating bucket 500 having tooth bar arms 138 and Link arms 160. Link arms 160 are connected to tooth bar arms 138 via hinge pins 139, mounting plate 501, and bolts 504 and washers 503. Tooth bar arms 138 are pivotally affixed to the later sides 120 via hinge pins 164 and mounted on a grooved underside portion of tooth bar arms 138 via of which in turn are connected to hydraulic actuators 170 via pivot plate 502 with bolts 504 and waters 503. In operation, the tooth bar arms 138 of excavating bucket 100 in the fully-extended position as shown with FIG. 5B is guided by guide ring plates 104.

As depicted with FIGS. 1 and 5B, the combination excavating bucket 100 and 600 shows a notch of tooth bar arms 138 atop the flat portion of guide ring plates 104, which affords a secured position when the excavating bucket 100 is in the fully-extended position. During operation, the excavating bucket 100 in the fully-extended position moves to the fully-retracted position as shown with excavating bucket 300 with tooth bar arms 138 at a bottom portion of the guide ring plates 104 as depicted with FIG. 3.

In some embodiments, the excavating bucket further comprises means for securing the tooth bar over the smooth cutting bar in the fully-extended position. In some embodiments, the smooth cutting bar and the tooth bar are adapted to provide a locking engagement with each other when the tooth bar is in the fully-extended position. In certain embodiments the combination excavating bucket of the present invention includes means for securing the tooth bar over the smooth cutting such that the tooth bar is not displaced during use thereof in a digging operation. For example, in one embodiment the smooth cutting bar and the tooth bar are adapted to provide a locking engagement with each other when the tooth bar is in said down, fully-extended position. In one such embodiment, the smooth cutting bar has an outward facing V-shaped edge and the inner edge of the tooth bar has an inwardly facing V-shaped pocket for mating and providing locking engagement with the V-shaped edge of said smooth cutting bar.

The combination excavating bucket of the present of the present invention is adapted for connection to a power driven excavating vehicle such as a skid steer, a loader, a backhoe, an excavator or a tractor. In one embodiment the combination excavating bucket of the present of the present invention is adapted for connection to a skid steer.

DEFINITIONS

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

While certain embodiments have been illustrated and described, it should be understood that changes and modifications can be made therein in accordance with ordinary skill in the art without departing from the technology in its broader aspects as defined in the following claims.

The present disclosure is not to be limited in terms of the particular embodiments described in this application. Many modifications and variations can be made without departing from its spirit and scope, as will be apparent to those skilled in the art. Functionally equivalent methods and devices within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods or devices, which can of course vary. It is also to be understood that the terminology used herein is for the purpose of describing particular embodiments only, and is not intended to be limiting.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

What is claimed is:

1. A combination excavating bucket adapted for connection to a power driven excavating vehicle, comprising:

a) a bucket comprising a base and a transverse smooth cutting bar along a leading edge of the base, b) a retractable tooth bar pivotally mounted to inner opposed lateral sides of the excavating bucket, wherein the tooth bar comprises a plurality of teeth extending outwardly from the tooth bar, and a pivot means for alternately moving the tooth bar between i. a fully-extended position, wherein the tooth bar fits over the smooth cutting bar thereby permitting the bucket to function as a tooth-edged bucket; and ii. a fully-retracted position, wherein the tooth bar is retracted away from the smooth cutting bar and the smooth cutting bar is exposed thereby permitting the bucket to function as a smooth-edged bucket, wherein the pivot means comprises first and second pivot arms pivotally mounted to the bucket, a first link arm operably connecting the first pivot arm to the tooth bar and a second link arm operably connecting the second pivot arm to the tooth bar along the inner opposed lateral sides of the excavating bucket, and wherein the first link arm and second link arm are operably guided with a first and a second guide ring plate along the inner opposed lateral sides of the excavating bucket.

2. The combination excavating bucket according to claim 1, wherein the pivot means further comprises a first hydraulic actuator operably connected to the first pivot arm and a second hydraulic actuator operably connected to the second pivot arm.

3. The combination excavating bucket according to claim 2, wherein the first hydraulic actuator comprises a first hydraulic cylinder and a first hydraulic cylinder rod, and the second hydraulic actuator comprises a second hydraulic cylinder and a second hydraulic cylinder rod.

4. The combination excavating bucket according to claim 3, wherein the first hydraulic cylinder rod is pivotally connected to the first pivot arm and the second hydraulic cylinder rod is pivotally connected to the second pivot arm.

5. The combination excavating bucket according to claim 1, wherein the excavating bucket further comprises means for securing the tooth bar over the smooth cutting bar in the down working position.

6. The combination excavating bucket according to claim 1, wherein the smooth cutting bar and the tooth bar are adapted to provide a locking engagement with each other when the tooth bar is in the down working position.

7. The combination excavating bucket according to claim 6, wherein the smooth cutting bar has an outward facing V-shaped edge and wherein the inner edge of the tooth bar has an inwardly facing V-shaped pocket for mating and providing locking engagement with the V-shaped edge of the smooth cutting bar.

8. The combination excavating bucket according to claim 1, wherein the power driven excavating vehicle is a skid steer, a loader, a backhoe, an excavator or a tractor.

9. The combination excavating bucket according to claim 8, wherein the power driven excavating vehicle is a skid steer.

10. The combination excavating bucket according to claim 1, further comprising that an angle of rotation from the fully-extended position to the fully-retracted position is about 163 degrees.

* * * * *